United States Patent [19]

Shank, Jr. et al.

[11] 4,245,467

[45] Jan. 20, 1981

[54] ISOLATED REVERSE TURBINE SYSTEM FOR GAS TURBINE ENGINES

[76] Inventors: Samuel R. Shank, Jr., 1106 Pennypacker La., Bowie, Md. 20716; Thomas L. Bowen, Box 111, Dares Beach, Prince Frederick, Md. 20678

[21] Appl. No.: 973,986

[22] Filed: Dec. 28, 1978

[51] Int. Cl.[3] ..... F02C 6/00

[52] U.S. Cl. ..... 60/39.15; 415/153 R

[58] Field of Search ..... 60/39.15; 415/153 R

[56] References Cited

U.S. PATENT DOCUMENTS

| | | | |
|---|---|---|---|
| 1,550,710 | 8/1925 | Schmidt | 415/153 |
| 2,529,773 | 11/1950 | Johansson | 415/153 |
| 2,718,751 | 9/1955 | Huber | 415/153 |
| 3,050,946 | 8/1962 | Marque | 60/39.15 |
| 3,825,367 | 7/1974 | Lewis | 415/153 |

*Primary Examiner*—Louis J. Casaregola

*Attorney, Agent, or Firm*—R. S. Sciascia; L. A. Marsh

[57] ABSTRACT

A reversing system for gas turbine engines having, in addition to a conventional gas generator and power turbine, a reversing turbine coupled to the exhaust end of the power turbine output shaft, a gas flow proportioning inlet mechanism, and a movable blocking exhaust valve. Intermediate and full-stop power settings are achieved by proportioning the gas flow between the forward and the reverse turbines, and windage losses are minimized by selectively blocking the gas flow through the turbines.

6 Claims, 12 Drawing Figures

ISOLATED REVERSE TURBINE SYSTEM FOR GAS TURBINE ENGINES

The invention described herein may be manufactured and used by or for the Government of the United States of America for governmental purposes without the payment of any royalties thereon or therefor.

BACKGROUND OF THE INVENTION

This invention relates generally to gas turbine engines, and more particularly to a system for controllably reversing the direction of rotation of an output shaft connected thereto.

The gas turbine engine, a thermodynamic device for supplying shaft power, is fundamentally unidirectional with respect to output shaft rotation. In many applications, such as ship propeller drives, it is necessary to have the capability of reversing the direction of rotation of the engine. One method employed in prior art gas turbine engines is the use of power turbine nozzles having a variable geometry. However, this necessitates compromises in the design of the power turbine nozzles and vanes, thus reducing the engine fuel economy during normal operation. Another method involves a separate reversing turbine mounted concentrically within the power turbine. Fuel economy is also sacrificed with this method because of the necessary design compromises in the power turbine inlet passages, first stage nozzles, and exhaust passages. Other ship reversing systems have included controllable-pitch propellers with their attendant disadvantages of added cost, weight, complexity, and increased appendage drag.

SUMMARY OF THE INVENTION

Accordingly, the present invention overcomes many of the disadvantages of prior art gas turbine reversing methods by providing a system that minimized losses during normal, i.e., forward mode, operation and is suitable for use with fixed-pitch propellers.

According to one embodiment of the present invention, a reverse turbine is mounted on the output shaft of a conventional gas turbine engine. An inlet valve mechanism is mounted between the gas generator and the power turbine and includes a plurality of radially movable diverter blocks, each diverter block being a segment of an annular ring. In the reverse mode of operation, the diverter blocks are moved radially inward to block the annular flow channel and divert the flow of gases from the gas generator into a collector scroll and thereafter, by means of bypass ducting, to a reverse turbine inlet scroll. A movable exhaust valve, in the form of a conical diffuser, is positioned so as to block the exhaust end of the power turbine while allowing the gases to flow through the reverse turbine and into an exhaust elbow.

In the forward mode of operation, the diverter blocks are retracted and then sealed off by a plurality of rectangular flaps which, when closed, force the gases to flow through the power turbine. The movable conical diffuser is positioned so as to block the exhaust end of the reverse turbine. A shut-off valve in each bypass duct, in conjunction with the conical diffuser, isolates the reverse turbine and minimizes windage losses therefrom. The shut-off valves may also be used in conjunction with the diverter blocks and conical diffuser to proportion the gas flow between the turbines and thereby provide additional torque control.

OBJECTS OF THE INVENTION

It is therefore an object of the present invention to provide a gas turbine engine reversing system that minimizes windage losses during the forward mode of operation.

Another object of the invention is to provide a system that permits torque control by proportioning the gas flow between the forward and reverse turbines.

Still another object of the present invention is to provide a system for reversing the direction of rotation of the output shaft that is adaptable to existing gas turbine engines.

Yet another object of the present invention is to provide a gas turbine reversing system for ship propulsion applications that can be used with a fixed pitch propeller.

A further object of the present invention is to provide a reversing system in which the power and reversing turbines are mounted on a common output shaft and wherein the gas flow to either of the turbines may be selectively blocked, thereby isolating the selected turbine and minimizing losses.

A still further object of the present invention is to provide a system wherein during the full reverse mode of operation of novel inlet valve diverter mechanism directs the gas flow from the gas generator to the reverse turbine, while a conical diffuser blocks the power turbine exhaust, thereby completely isolating the power turbine.

BRIEF DESCRIPTION OF THE DRAWINGS

Other objects and many of the attendant advantages of the present invention will be readily apparent as the invention becomes better understood by reference to the following detailed description with the appended claims, when considered in conjunction with the accompanying drawings, wherein:

DESCRIPTION OF THE PREFERRED EMBODIMENT

Figure 1:
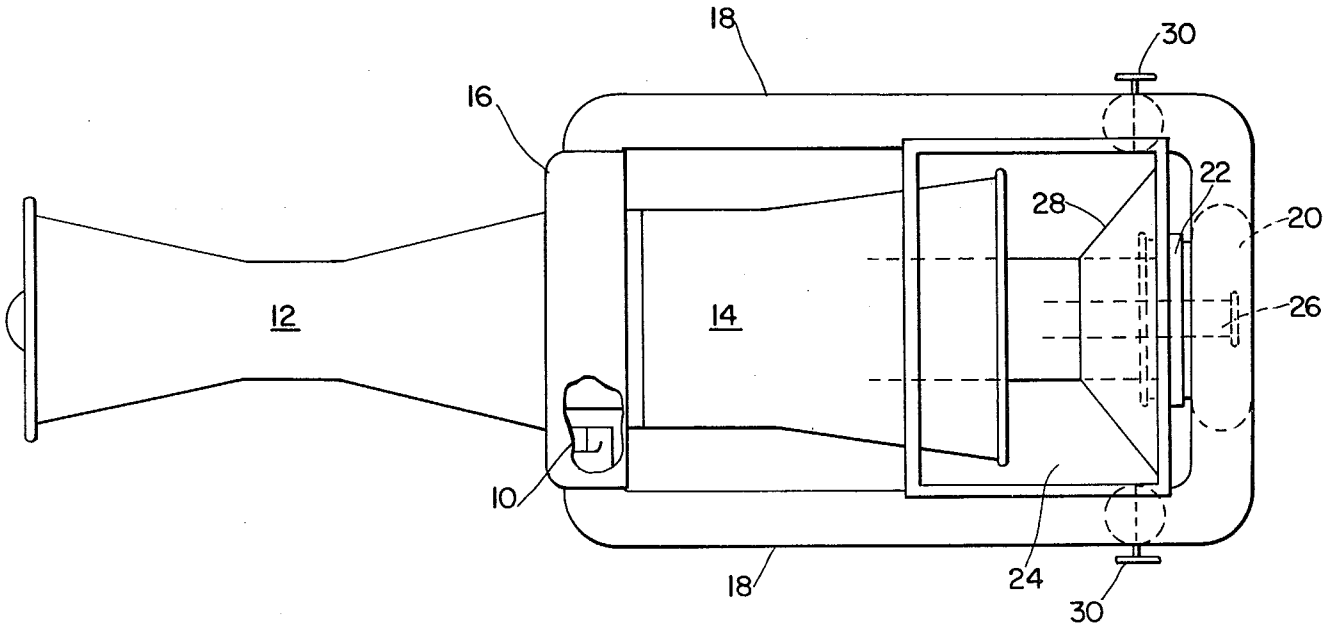
FIG. 1 is a diagrammatic top view of the reverse turbine apparatus according to the present invention as applied to a conventional gas generator and power turbine.

Referring now to the drawings, wherein like reference numerals designate the same or corresponding parts throughout the several views, there is shown in FIG. 1 a gas turbine engine having a controllable inlet valve mechanism 10 mounted between the exhaust end of a gas generator 12 and the inlet of a power turbine 14. Inlet valve mechanism 10, which will be described in greater detail hereinbelow, is spaced concentrically within an annular collector scroll 16 which, by means of a plurality of bypass ducts 18 during reverse operation of the engine, transfers the working fluid to an annular reverse turbine inlet scroll 20 located at the rearmost portion of the gas turbine engine. A reverse turbine 22 is located just forward of inlet scroll 20 and spaced from the exhaust end of power turbine 14, said turbines being mounted on a common output shaft 26. The back-to-back arrangement of power turbine 14 and reverse turbine 22 permits the exhaust from both turbines to be discharged into a common exhaust elbow 24. A positionable exhaust valve 28, whose operation will be described in detail below, acts as either a conical diffuser for power turbine 14 and blocking exhaust valve for reverse turbine 22 or a blocking exhaust valve for power turbine 14, depending upon whether the gas turbine engine is operating in the forward or the reverse mode. A shut-off valve 30, mounted within and spaced in the downstream portion of each bypass duct 18, may be positioned so as to restrict the flow of working fluid to reverse turbine 22. Exhaust valve 28 is used in conjunction with shut-off valve 30 to completely isolate reverse turbine 22 during forward operation of the engine. Shut-off valve 30 and exhaust valve 28 may conveniently be hydraulically or motor operated. Selective positioning of inlet valve mechanism 10, exhaust valve 28, and shut-off valves 30 permits either the proportioning of the working fluid flow, thereby balancing the torque of both turbines and stopping the rotation of output shaft 26, or the gradual increasing of the flow to one turbine or the other, thereby providing slightly unbalanced torque during forward or reverse low shaft speed operation.

Figure 2:
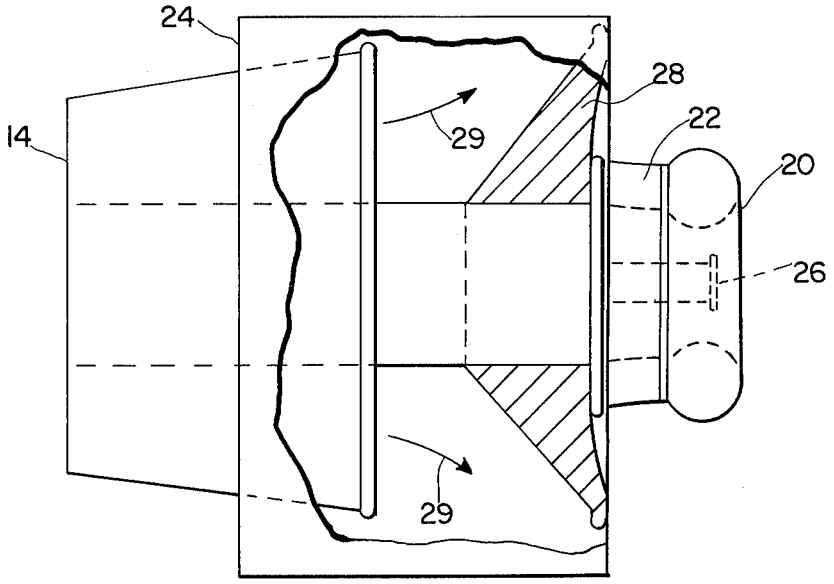
FIG. 2 is a partially cut-away elevational view of the exhaust elbow portion of the present invention with the gas turbine in the forward mode of operation.

Referring now to FIG. 2, a partially cut-away view of exhaust elbow 24 shows the position of exhaust valve 28 when the gas turbine engine is in the full forward mode of operation, that is, when all of the working fluid flows through power turbine 14 as indicated by the arrows 29 in the drawing. In this position exhaust valve 28 acts as a conical diffuser and radially directs the gas flow into exhaust elbow 24. Also, valve 28 blocks the exhaust end of reverse turbine 22, preventing any gas flow therethrough and minimizing windage losses therefrom.

Figure 3:
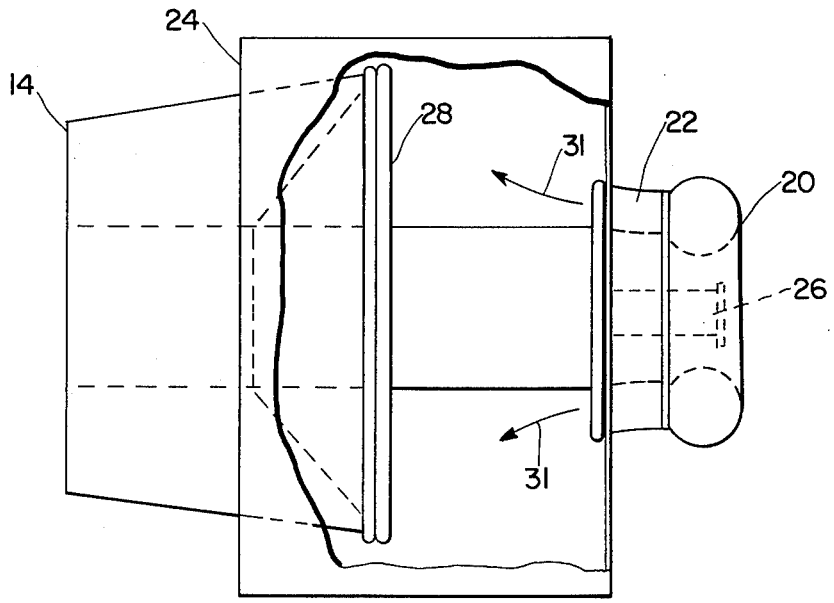
FIG. 3 is a view of the exhaust elbow portion shown in FIG. 2 with the gas turbine in the reverse mode of operation.

For full reverse operation of the gas turbine engine, exhaust valve 28 is positioned as shown in FIG. 3, wherein valve 28 blocks the exhaust end of power turbine 14. The working fluid now flows from inlet scroll 20 through reverse turbine 22 and into exhaust elbow 24, as indicated by arrows 31 in the drawing. As described above, during operation of both turbines, for example, during low shaft speed operation, exhaust valve 28 is positioned so as to be spaced apart from the exhaust ends of both turbines.

Figure 4:
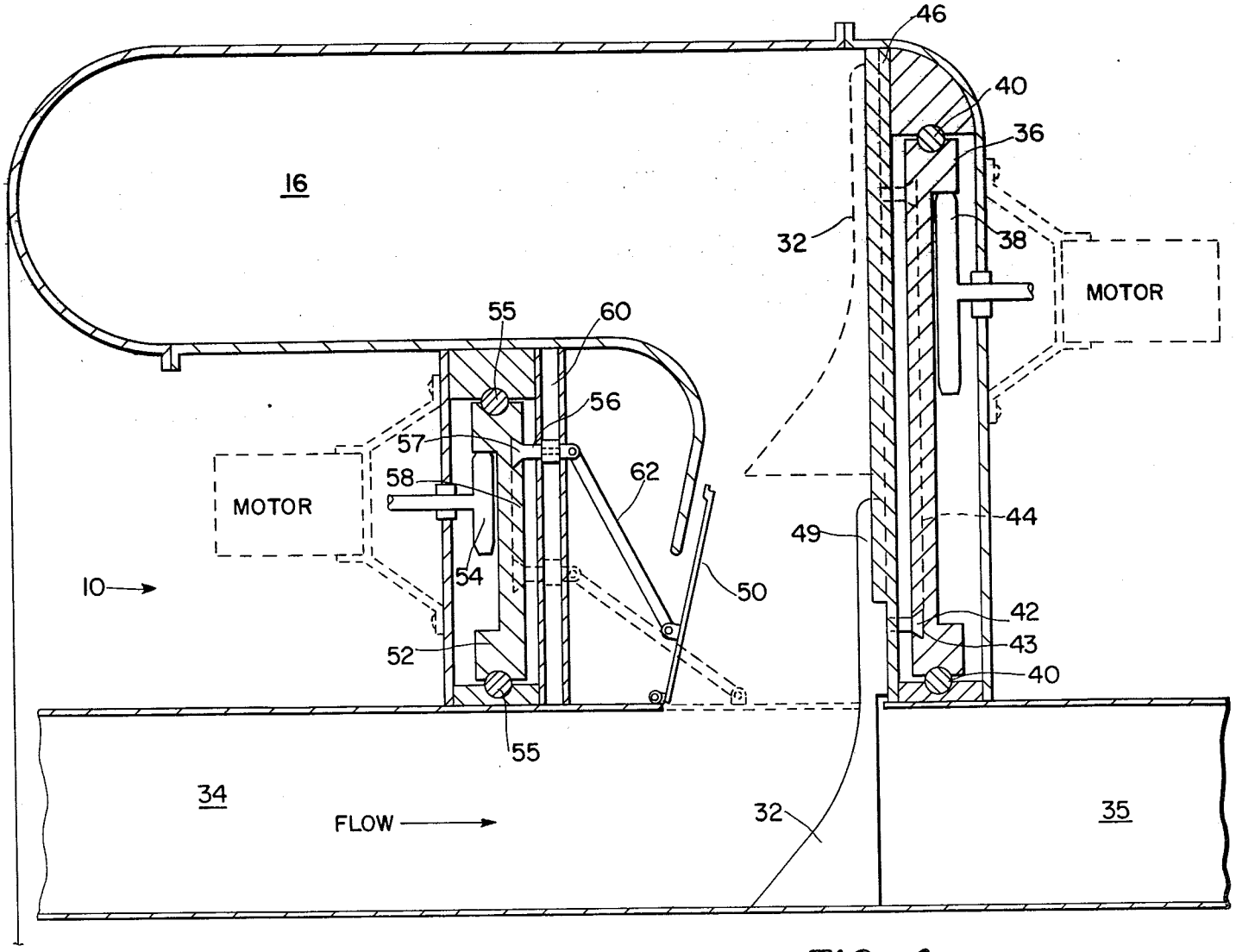
FIG. 4 is an enlarged cross-sectional view of one portion of the inlet valve mechanism shown in FIG. 1, showing the structure thereof in greater detail.
Figure 4A:
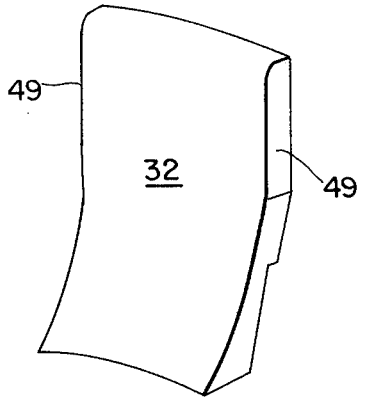
FIG. 4*a* is a perspective view of one of the diverter blocks in the inlet valve mechanism of FIG. 4, as viewed from the upstream side.
Figure 4B:
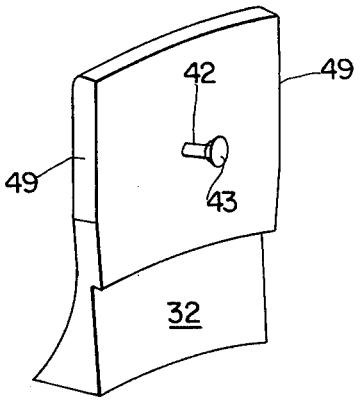
FIG. 4*b* is a perspective view of the diverter block shown in FIG. 4*a* as viewed from the downstream side.
Figure 6:
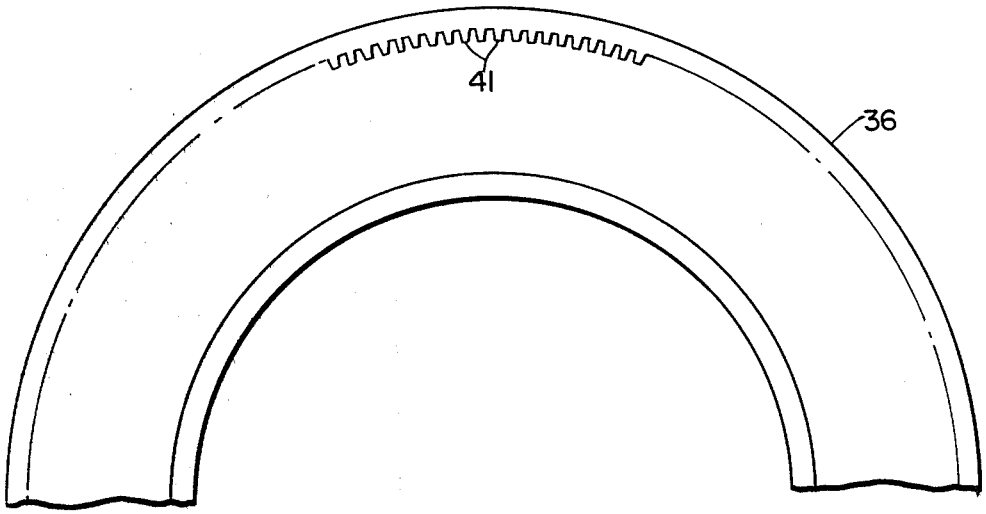
FIG. 6 is an elevational view of the cam and ring gear shown in FIG. 5, as viewed from the downstream side.

Referring now to FIG. 4, wherein the exhaust end of gas generator 12 is to the left in the drawing and the inlet of power turbine 14 is to the right in the drawing, the top portion of inlet valve mechanism 10 is shown in greater detail. Working fluid from gas generator 12 flows through an annular channel 34 and, in the full forward mode, into an inlet flow area 35 of turbine 14. In the reverse mode of operation a plurality of diverter blocks 32, each being an annular segment of a shaped-ring and indicated by solid lines in the drawing, are moved radially inward into the annular channel 34 so that the inlet flow area 35 of power turbine 14 is closed off and the working fluid is radially diverted into collector scroll 16. In the forward mode of operation diverter blocks 32 are retracted to the position indicated by the dashed lines in the drawing. Insertion and retraction of diverter blocks 32 is controlled by a combination cam and ring gear 36 which is driven by means of a motorized gear 38. Cam and ring gear 36 is rotatably supported by a plurality of bearings 40 positioned about the inner and outer circumferences thereof. The downstream face of gear 36 is recessed and a plurality of circumferentially located teeth 41, more clearly seen in FIG. 6, are provided thereon, the teeth 41 facing radially inward and being formed so as to mesh with similar teeth on motorized gear 38. An anchor post 42 having a flared end 43 is affixed to the back of each diverter block 32, end 43 being inserted into one of a plurality of arcuate slots 44 formed into the upstream face of cam and ring gear 36. The configuration of an anchor post 42 on a typical diverter block 32 and the general shape of the diverter block can more clearly be seen by referring to FIGS. 4*a* and 4*b*.

Figure 5:
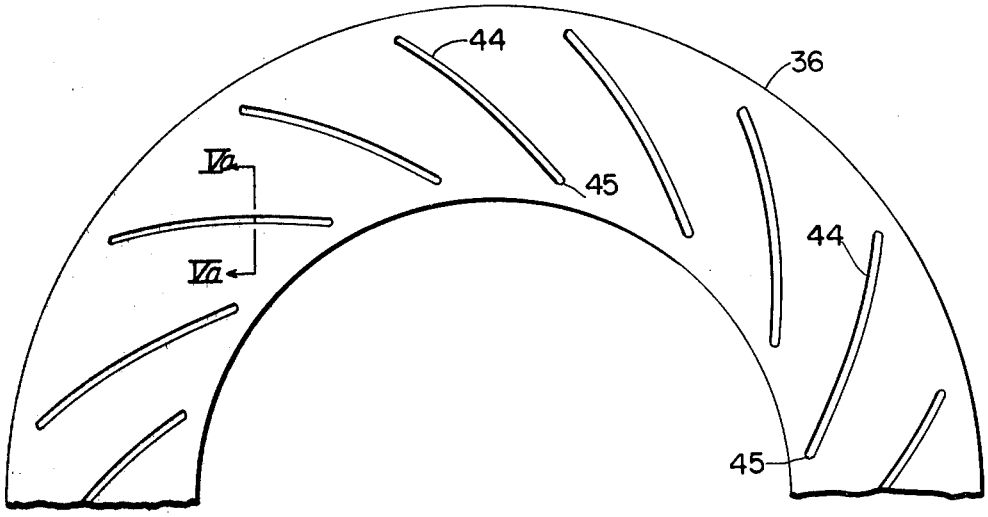
FIG. 5 is an elevational view of the top half of the combination cam and ring gear according to the present invention, as viewed from the upstream side.
Figure 5A:
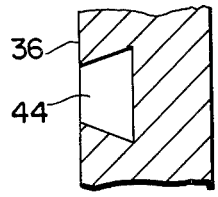
FIG. 5*a* is a partial cross-sectional view of the cam and ring gear of FIG. 5, showing the details of one of the arcuate slots therein as viewed in the plane of line Va—Va.

As best seen in FIG. 5, slots 44 have an arcuate shape so that a clockwise rotation of gear 36 moves diverter blocks 32 radially outward, and a counterclockwise rotation of gear 36 moves diverter blocks 32 radially inward. The length of slots 44 determines the radial travel of diverter blocks 32, the innermost end 45 of each slot 44 being configured so that anchor post 42 meets inner end 45 when diverter block 32 is seated on the inner wall of annular channel 34. Referring to FIG. 5*a*, each slot 44 is beveled so as to conform to the shape of flared end 43 of anchor post 42, thereby retaining end 43 therein.

Figure 7:
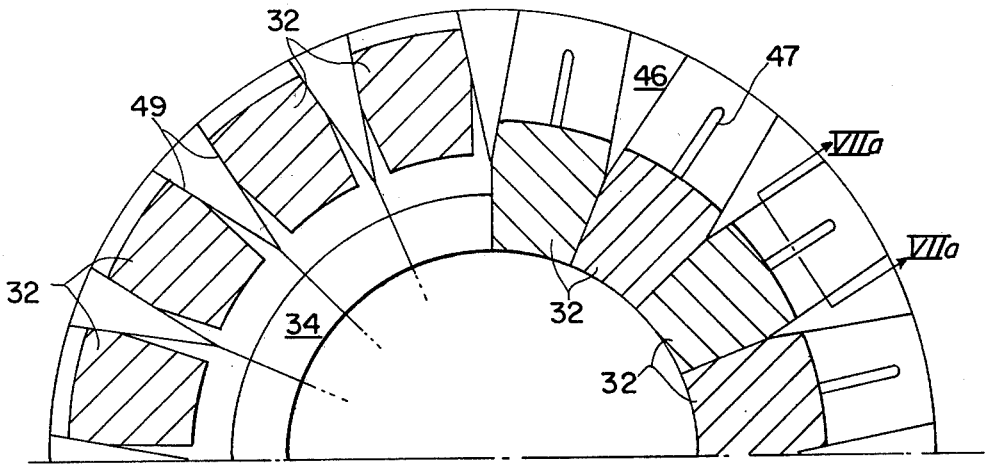
FIG. 7 is an elevational view of the top half of the guide ring according to the present invention, as viewed from the upstream side.
Figure 7A:
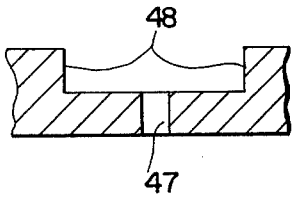
FIG. 7*a* is a partial cross-sectional view of the guide ring shown in FIG. 7, showing details of one of the radial slots and one of the slide-ways as viewed in the plane of line VII*a*—VII*a*.

Each diverter block 32 is restricted to move only in a radial direction by means of a guide ring 46, which can more clearly be seen by referring to FIGS. 7 and 7*a*. The anchor post 42 on each diverter block 32 slides radially up and down slot 47 as the diverter block is raised and lowered. The diverter blocks 32 on the right side of FIG. 7 are shown in the lowered position (reverse mode), while the diverter blocks 32 on the left side of FIG. 7 are shown in the raised position (forward mode). Referring to FIG. 7*a*, slide-ways 48 are provided on the upstream face of guide ring 46 for maintaining the stability of the diverter blocks when raised or lowered. Parallel alignment faces 49 on each diverter block 32 fit within the edges of slide-way 48.

To provide a space from which diverter blocks 32 can be inserted or retracted, the outer cylindrical wall of annular channel 34 is radially sectioned into a plurality of nearly flat rectangular flaps 50 which are hinged on their upstream side. When the gas turbine engine is operating in the forward mode, flaps 50 are in the position as shown by the dashed lines in the drawing, with diverter blocks 32 in the retracted position. Annular channel 34 thus becomes a continuous passage for the gas flow from gas generator 12 to power turbine 14. In the reverse mode, the flaps 50 open outwardly and permit diverter blocks 32 to move radially into annular flow channel 34. The flap operating mechanism is similar to the diverter block operating mechanism, having a combination cam and ring gear 52 driven by a motorized gear 54 and rotatably supported by a plurality of bearings 55. Each flap 50 is movably connected by means of a lever arm 62 to an anchor post 56 having a flared end 57. The flared end 57 of each anchor post 56 is inserted into one of a plurality of arcuate slots 58 formed into the downstream face of gear 52. A pair of fixed guide rails 60 (one shown) act as stabilizers and maintain a purely radial movement of anchor post 56 as gear 52 is rotated. As in gear 36, one face of cam and ring gear 52 is recessed and provided with inwardly facing teeth configured to mesh with motorized gear 54. As viewed from the downstream side, a counterclockwise rotation of gear 52 moves each anchor post 56 radially inward and closes flap 50, while a clockwise rotation of gear 52 moves anchor post 56 radially outward, thus opening flap 50.

Figure 8:
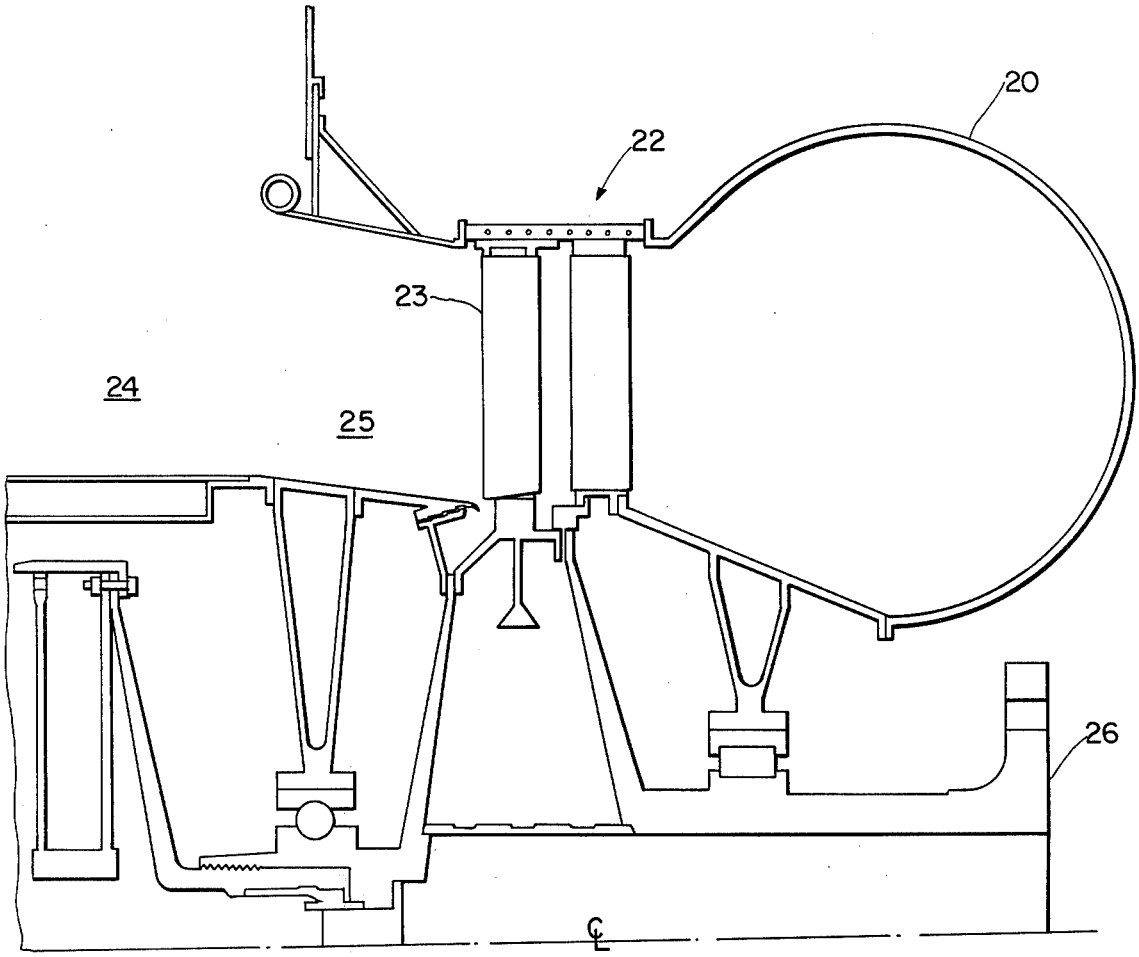
FIG. 8 is a diagrammatic elevational view of a portion of the reverse turbine section of the present invention.

There is shown in FIG. 8 one configuration of the reverse turbine section of a gas turbine engine according to the present invention wherein a single-stage, axial-flow turbine 22 is affixed to output shaft 26. In the reverse mode of operation, the reverse turbine inlet scroll 20 directs the gas flow through a plurality of turbine blades 23 to an exhaust diffuser 25, from which it is discharged into exhaust elbow 24.

In operation, when the gas turbine engine according to the present invention is in the full forward mode, diverter blocks 32 are retracted and flaps 50 are closed so that all of the working fluid discharging from gas generator 12 is directed through annular flow channel 34 to the inlet 35 of power turbine 14. Exhaust valve 28 is at its rearmost position so that the exhaust end of reverse turbine 22 is completely blocked, while valve 28 acts as a conical diffuser for the exhaust flow discharging from power turbine 14. Reverse turbine 22 is further isolated by the closure of shut-off valves 30.

When the gas turbine engine is operated in the full reverse mode, flaps 50 are opened and diverter blocks 32 are fully inserted into annular flow channel 34, whereby all of the working fluid is directed through collector scroll 16 and into bypass ducts 18. Shut-off valves 30 are fully opened so that the working fluid flows into reverse turbine inlet scroll 20. Exhaust valve 28 is moved to the full forward position, blocking the exhaust end of power turbine 14 and permitting the working fluid to flow through reverse turbine 22 and into exhaust elbow 24. Intermediate and full-stop power settings are achieved by proportioning the working fluid flow between power turbine 14 and reverse turbine 12. The flow is proportioned by a combination of partial insertion of diverter blocks 32 into annular channel 34, partial closure of shut-off valve 30, and the spacing of exhaust valve 28 at a position intermediate of the exhaust ends of the turbines. Output shaft 26 is stopped when the torque produced by power turbine 14 equals the torque produced by reverse turbine 12.

Thus, it is apparent that there is provided by the present invention a reversing system for gas turbine engines having means for selectively isolating the unused turbine and minimizing windage losses therefrom without sacrificing the forward mode performance of the engine. There is also provided a means for proportioning the working fluid flow between the power and reverse turbines throughout the power range of the gas generator.

Obviously, many modifications and variations of the present invention are possible in the light of the above teachings. It is therefore to be understood that within the scope of the appended claims the invention may be practiced otherwise than as specifically described.

What is claimed is:

1. A reversible gas turbine engine, in combination:

a gas generator for discharging working fluid into an annular flow channel;

a power turbine affixed to an output shaft which is rotatably mounted downstream of said gas generator, for rotating said output shaft in one direction;

means coupled to the inlet of said power turbine and to the exhaust of said gas generator for diverting said working fluid away from the inlet of said power turbine;

said means being annular and mounted coaxially with said turbine, and, said means further comprising:

a plurality of radially movable diverter blocks, each of said blocks comprising a segment of an annular ring and having an upstream face of streamlined cross-section, each of said diverter blocks further being shaped in a manner such that when fully inserted radially inward into said annular flow channel, said diverter blocks form a closed annular ring that completely blocks said flow channel;

an anchor post, having a flared end, perpendicularly affixed to the downstream face of each of said diverter blocks with said flared end facing downstream;

a pair of parallel alignment faces formed onto the sides of each of said diverter blocks, said alignment faces running a portion of the length of said diverter blocks in a radial direction;

a plurality of fixedly mounted radial slide-ways, each of said slide-ways configured for slidable insertion of a corresponding diverter block, whereby said diverter blocks are constrained to move only in a radial direction by said alignment faces and said anchor posts;

a first drive means coupled to said diverter blocks for radially moving said diverter blocks into or out of said annular flow channel;

a plurality of circumferentially spaced flaps hingedly mounted on the outer wall of said annular flow channel, one of said flaps being provided for each of said diverter blocks, and each of said flaps being movable only in a radially outward direction and configured to permit said diverter blocks to move into and out of said annular flow channel when said flaps are opened; and a second drive means for opening and closing said flaps in unison;

a reverse turbine, having at lease one stage, affixed to said output shaft downstream of said power turbine for rotating said output shaft in an opposite direction, said reverse turbine being oriented in such a manner that its exhaust end faces the exhaust end of said power turbine;

means coupled to said diverting means and the inlet of said reverse turbine for transferring said working fluid therebetween;

a shut-off valve mounted within the downstream portion of said transferring means, for restricting the working fluid flow therethrough;

exhaust blocking means slidably mounted between the exhaust of said power and said reverse turbines and configured so that said exhaust blocking means can selectively block the exhaust end of one or the other of said turbines, or can be positioned at some point therebetween; and exhaust means coupled to said exhaust blocking means for collecting the working fluid from the exhaust of either or both of said turbines and discharging it therefrom.

2. The gas turbine engine of claim 1, wherein said transferring means comprises:

a collector scroll concentrically spaced from said diverting means so as to form an annular enclosure around said diverting means;

an annular inlet scroll affixed to the downstream end of said gas turbine engine and coupled to the inlet of said reverse turbine; and a plurality of bypass ducts, each duct being coupled at its upstream end to said collector scroll and at its downstream end to said inlet scroll.

3. The gas turbine engine of claim 2, wherein said exhaust blocking means comprises:

a diffuser in the form of a truncated cone oriented along the longitudinal axis of said gas turbine engine and having its smaller end facing upstream, said diffuser being configured so as to completely block the exhaust end of said power turbine at its forwardmost position, and to completely block the exhaust end of said reverse turbine at its rearmost position; and means for slidably moving said diffuser along its longitudinal axis to any point between its forwardmost and its rearmost limits of travel.

4. The gas turbine engine of claim 3, wherein said exhaust means comprises:

an exhaust elbow positioned at the exhaust ends of said power and said reverse turbines, said exhaust elbow being configured so as to form an enclosure around said exhaust ends, whereby the exhaust flow discharing from said turbines upon passing through said exhaust elbow is discharged from said gas turbine engine in a radial direction.

5. The gas turbine engine of claim 4, wherein said first drive means comprises:

an annular cam and ring gear rotatably mounted on the outer wall of said annular flow channel and positioned perpendicularly to the longitudinal axis thereof, said gear having a substantially flat upstream face and a recessed downstream face;

a plurality of circumferentially spaced arcuate slots formed into the upstream face of said cam and ring gear, one slot being provided for each diverter block and configured to receive the flared end of each of said anchor posts therein, said slots further being configured so that a clockwise rotation of said gear as viewed from the upstream face moves said diverter blocks in a radial outward direction and a counterclockwise rotation of said gear moves said diverter blocks in a radial inward direction;

a plurality of radially inwardly facing gear teeth affixed to the outer edge of the recessed portion of the downstream face of said cam and ring gear; and motorized gear means configured to movably mesh with said gear teeth, whereby said cam and ring gear rotates through an arc sufficient to controllably move said diverter blocks into and out of said annular flow channel.

6. The gas turbine engine of claims 4 or 5, wherein said second drive means comprises:

a plurality of lever arms, one of said lever arms hingedly attached to one end of each of said flaps;

a plurality of movable blocks, each of said blocks being hingedly attached on its downstream end to the end of one of said lever arms opposite said flaps, each of said movable blocks further having a flared projection on its upstream end positioned along its longitudinal axis;

a plurality of fixedly mounted, parallel pairs of radial guide bars, each of said pairs of guide bars positioned for slidable contact with one of said movable blocks, whereby said movable blocks are constrained to move only in a radial direction;

an annular cam and ring gear rotatably mounted on the outer wall of said annular flow channel and positioned perpendicularly to the longitudinal axis thereof, said gear having a substantially flat downstream face and a recessed upstream face;

a plurality of circumferentially spaced arcuate slots formed into the downstream face of said cam and ring gear, one slot being provided for each flap and configured to receive the flared projection of each of said movable blocks therein, said slots further being configured so that a clockwise rotation of said gear as viewed from the downstream face moves said flaps in a radial outward direction and a counterclockwise rotation of said gear moves said flaps in a radial inward direction;

a plurality of radially inwardly facing gear teeth affixed to the outer edge of the recessed portion of the upstream face of said cam and ring gear; and motorized gear means configured to movably mesh with said gear teeth, whereby said cam and ring gear rotates through an arc sufficient to fully open and close said flaps.

* * * * *